US006401251B1

(12) United States Patent
Fredenberg

(10) Patent No.: US 6,401,251 B1
(45) Date of Patent: Jun. 11, 2002

(54) COMBINATION BOLO AND FABRIC TIE AND METHOD THEREFOR

(76) Inventor: James Paul Fredenberg, 2870 W. Kiltie La., Flagstaff, AZ (US) 86001

( * ) Notice: Subject to any disclaimer, the term of this patent is extended or adjusted under 35 U.S.C. 154(b) by 0 days.

(21) Appl. No.: 09/810,270

(22) Filed: Mar. 19, 2001

(51) Int. Cl.[7] ..... A41D 25/08

(52) U.S. Cl. ..... 2/144; 2/145; 2/152.1; 24/49.1

(58) Field of Search ..... 2/144–145, 148–150, 2/152.1, 153, 156, 157; 24/49.1, 66.9, 115 M

(56) References Cited

U.S. PATENT DOCUMENTS 3,187,396 A * 6/1965 Carroll ..... 24/123
4,771,481 A * 9/1988 Gasser ..... 2/150
5,088,120 A * 2/1992 Yen ..... 2/152.1
5,461,726 A * 10/1995 Wade ..... 2/144
5,600,852 A * 2/1997 Densch ..... 2/144
5,765,227 A * 6/1998 Wright ..... 2/144
5,774,893 A * 7/1998 Torres ..... 2/148

* cited by examiner

*Primary Examiner*—Gloria M. Hale
*Assistant Examiner*—Tejash Patel
(74) *Attorney, Agent, or Firm*—Jeffrey D. Moy; Harry M. Weiss; Weiss & Moy, P.C.

(57) ABSTRACT

A combination bolo tie and neck tie has an interchangeable neck cord for supporting the combination bolo tie and neck tie around a neck of a wearer. An interchangeable neck piece is coupled to the interchangeable neck cord. An interchangeable neck tie is coupled to the interchangeable neck piece. A holding bar is coupled to the interchangeable neck piece for securing the interchangeable neck cord to the interchangeable neck piece. A neck tie holder is coupled to the interchangeable neck piece for coupling the interchangeable neck tie to the interchangeable neck piece. An adjustment mechanism is coupled to the interchangeable neck tie for holding the interchangeable neck tie to the interchangeable neck piece and for adjusting a length of the interchangeable neck tie.

17 Claims, 1 Drawing Sheet

COMBINATION BOLO AND FABRIC TIE AND METHOD THEREFOR

BACKGROUND OF THE INVENTION

1. Field of the Invention

This invention relates to fashion accessories and, more specifically, to a combination bolo tie and fabric tie. The combination tie will combine features of both the bolo tie and the standard fabric tie into a unique looking and fashionable neckwear accessory.

2. Description of the Prior Art

For years, many people have added fashion accessories to their wardrobe. Fashion accessories such as neckwear have become standard business attire. Neckwear such as neckties, bolo ties, and bow ties have been around for many years. However, no new neckwear has been designed or has become popular for many years. Other than a change in their appearance (i.e., the designs on the fabric material of the necktie and bow tie, or decorative pieces on the neck clip of the bolo tie) neckwear has not changed.

Therefore, a need existed to provide a new type of fashion accessory. The new fashion accessory will be a new type of neckwear. The new neckwear will have the ability to interchange different components in order to provide an unlimited number of different and unique looks.

SUMMARY OF THE INVENTION

In accordance with one embodiment of the present invention, it is an object of the present invention to provide a new type of fashion accessory.

It is another object of the present invention to provide a new type of fashion accessory which is associated with neckwear.

It is still another object of the present invention to provide a new type of neckwear that will have the ability to interchange different components in order to provide an unlimited number of different and unique looks.

BRIEF DESCRIPTION OF THE PREFERRED EMBODIMENTS

In accordance with one embodiment of the present invention a combination bolo tie and neck tie is disclosed. The combination bolo tie and neck tie uses a neck cord for supporting the combination bolo tie and neck tie around a neck of a wearer. A neck piece is coupled to the neck cord. A neck tie is coupled to the neck piece.

In accordance with another embodiment of the present invention a combination bolo tie and neck tie is disclosed. The combination bolo tie and neck tie has an interchangeable neck cord for supporting the combination bolo tie and neck tie around a neck of a wearer. An interchangeable neck piece is coupled to the interchangeable neck cord. An interchangeable neck tie is coupled to the interchangeable neck piece. A holding bar is coupled to the interchangeable neck piece for securing the interchangeable neck cord to the interchangeable neck piece. A neck tie holder is coupled to the interchangeable neck piece for coupling the interchangeable neck tie to the interchangeable neck piece. An adjustment mechanism is coupled to the interchangeable neck tie for holding the interchangeable neck tie to the interchangeable neck piece and for adjusting a length of the interchangeable neck tie.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
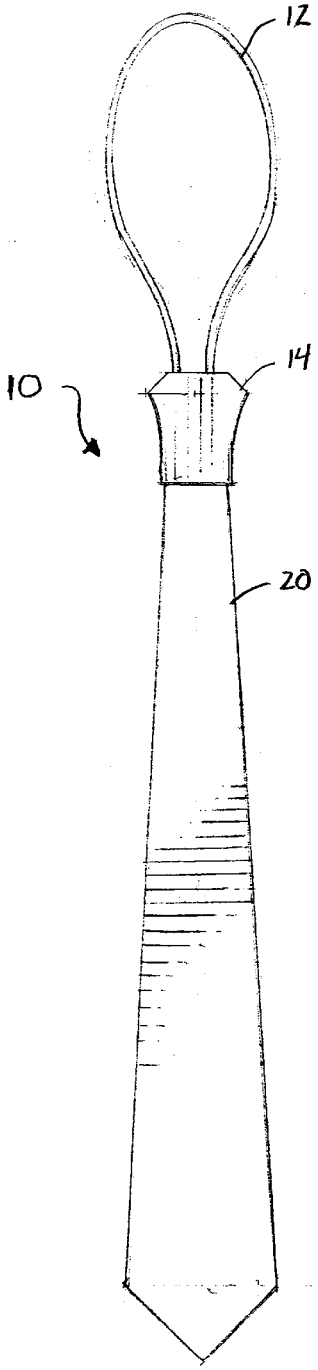
FIG. 1 is a front view of the combination bolo tie and fabric tie of the present invention.

Referring to the Figures, a combination bolo tie and fabric tie 10 (hereinafter tie 10) is shown. The tie 10 has a neck cord 12. The neck cord 12 is used to secure the tie 10 around the neck of the user. The neck cord 12 is further used to adjust the position of the tie 10 when worn by the user. The neck cord 12 is generally made out of leather, naugahyde, or like material. However, the neck cord 12 may be out of other natural or synthetic material. The neck cord 12 is interchangeable. Thus, the color and composition of the neck cord 12 may change in order to match the other components of the tie 10.

Coupled to the neck cord 12 is a neck piece 14. The neck piece 14 is interchangeable. Thus, different neck pieces 14 may be used with different neck cords 12. The neck pieces 14 are decorative and may be interchanged to provide different looks and appearances. The neck piece 14 may be made out of any type of material. For example, the neck piece may be made out of silver, gold, other precious, semi-precious, or non precious metals. Any type of metal alloy may be used. Leather or any other type of solid natural or synthetic materials may also be used. Precious or non precious stones may be used as the neck piece 14 itself or coupled to the material used to form the neck piece 14. It should be noted that the above mentioned are only examples of the materials that could be used to form the neck piece 14. They should not be seen as to limit the scope of the present invention.

The neck piece 14 is used to secure the neck cord 12 around the neck of the wearer. In order to secure the neck cord 12 around the neck of the user, the neck piece 14 has a holding bar 16 coupled thereto. The holding bar 16 is coupled to the neck piece 14 so that a small gap exists between the neck piece 14 and the holding bar 16. The gap is wide enough to allow each end of the neck cord 12 to slide through the gap, but narrow enough to securely hold the neck piece 14 around the neck cord 12 thus holding the neck cord 12 around the neck of the wearer. The holding bar 16 may further have a pair of channels running parallel to one another along a vertical axis on the holding bar 16. The channels are used to guide each end of the neck cord 12 through the gap as well as to securely hold the neck cord 12 within the gap.

Further coupled to the neck piece 14 is a tie holding mechanism 18. The tie holding mechanism 18 is used to hold a fabric tie 20 to the neck piece 14. In accordance with one embodiment of the present invention, the tie holding mechanism 18 is similar to the holding bar 16. The tie holding mechanism 18 is a piece of material that has a first end and a second end both of which are coupled to the neck piece 14.

Figure 2:
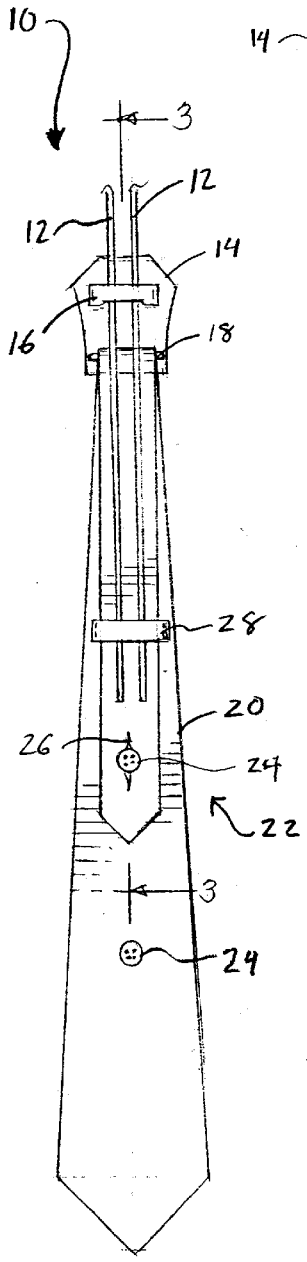
FIG. 2 is a rear view of the combination bolo tie and fabric tie depicted in FIG. 1.
Figure 3:
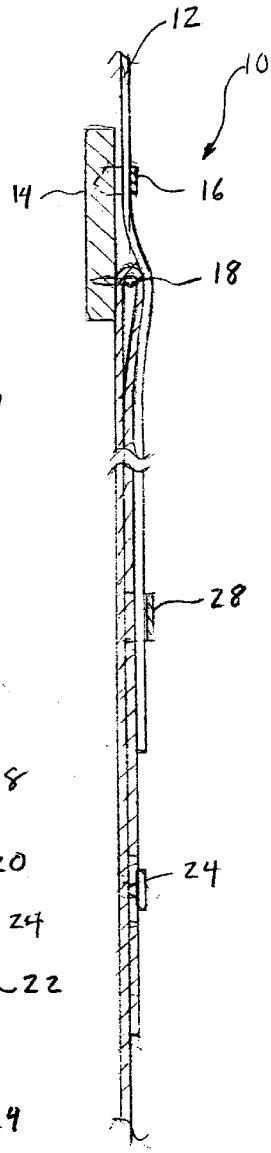
FIG. 3 is a cross-sectional side view of the combination bolo tie and fabric tie depicted in FIG. 2 taken along lines 3—3.
Figure 4:
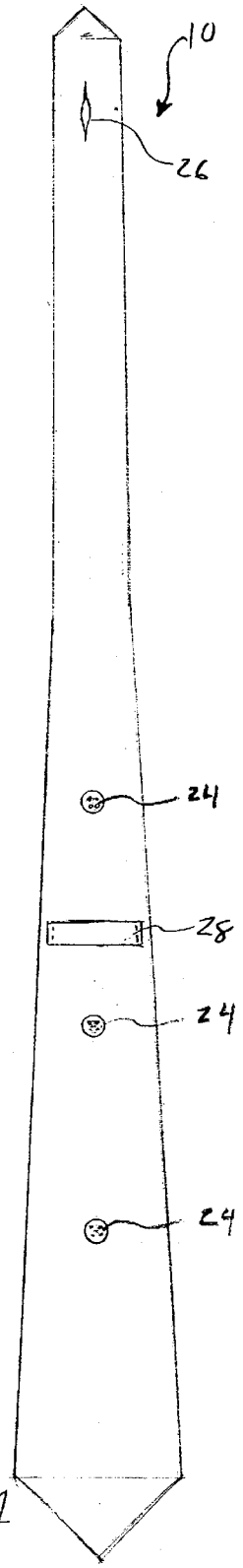
FIG. 4 is a rear view of the combination bolo tie and fabric tie in an extended position.

A gap exist between the tie holding mechanism 18 and the neck piece 14. The gap is wide enough to allow the smaller end of a standard fabric tie 20 to be positioned through the gap. As can be seen more clearly in FIG. 2, the smaller end of the fabric tie 20 is placed through the gap of the tie holding mechanism 18. A portion of the fabric tie 20 is then pulled through the gap so that a portion of the fabric tie 20 is hanging on both sides of the tie holding mechanism 18.

As stated above, a fabric tie 20 is coupled to the neck piece 14. The fabric tie 20 may be a standard neck tie 20 which may be purchased from any clothing store. The fabric tie 20 is interchangeable so that different fabric ties 20 may be coupled to the neck piece to give the tie 10 different looks and appearances.

In accordance with another embodiment of the present invention, the fabric ties 20 may be slightly modified. The modified fabric tie 20 would be similar to present fabric ties 20 that are purchased from clothing stores. The modified fabric tie 20 would be made out the same materials that the standard fabric ties 20 use. The fabric, natural or synthetic, would include but is not limited to, silk, cotton, linen, wool, leather, suede, reptile skins, and the like. It should be noted that the above mentioned are just examples and should not be seen as to limit the scope of the present invention. The modified fabric tie 20 would reduce the length of the traditional standard fabric tie 20. The length may be modified since the fabric tie 20 does not need to be wrapped around the neck of the user.

The modified fabric tie 20 may also have an adjustment mechanism 22 coupled thereto. The adjustment mechanism 22 is used to ensure that the modified fabric tie 20 remains coupled to the neck piece 14 and for adjusting the length of the modified fabric tie 20. The adjustment mechanism 22 would generally hold the smaller end of the modified fabric tie 20 to the larger end. The adjustment mechanism 22 could include the use of hook and loop material, button snaps and the like. In accordance with one embodiment of the present invention, the adjustment mechanism 22 has one or more buttons 24 coupled to a back portion of the modified fabric tie 20. The buttons 24 are generally arranged along a vertical axis along the back portion of the wider section of the modified fabric tie 20. One or more button holes 26 are made through the smaller end of the modified fabric tie 20. The user can adjust the length of the modified fabric tie 20 by placing one of the buttons 24 arranged along the vertical axis of the back portion of the wider section of the modified fabric tie 20 through one of the button holes 26.

The modified fabric tie 20 may further have a holder 28. The holder 28 would be coupled to the back portion of the modified fabric tie 20. The holder 28 is used to hold the smaller end of the modified fabric tie 20 and the neck cord 12 behind the wider section of the modified fabric tie 20. This is more clearly illustrated in FIG. 2.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A combination bolo tie and neck tie comprising, in combination:

a neck cord for supporting the combination bolo tie and neck tie around a neck of a wearer;

a neck piece coupled to the neck cord; and a neck tie coupled to the neck piece wherein the neck tie has an adjustment mechanism coupled thereto for holding the neck tie to the neck piece and for adjusting a length of the neck tie.

2. A combination bolo tie and neck tie in accordance with claim 1 wherein the neck cord is interchangeable.

3. A combination bolo tie and neck tie in accordance with claim 1 wherein the neck piece is interchangeable.

4. A combination bolo tie and neck tie in accordance with claim 1 wherein the neck tie is interchangeable.

5. A combination bolo tie and neck tie in accordance with claim 1 further comprises:

a holding bar coupled to the neck piece for securing the neck cord to the neck piece; and a neck tie holder coupled to the neck piece for coupling the neck tie to the neck piece.

6. A combination bole tie and neck tie in accordance with claim 1 wherein the adjustment mechanism comprises:

at least one button coupled to a rear section of the neck tie; and at least one opening located on an end of the neck tie wherein the opening is placed around one of the at least one button to hold the neck tie to the neck piece.

7. A combination bolo tie and neck tie in accordance with claim 1 wherein the adjustment mechanism comprises:

a plurality of buttons coupled to a rear section of the neck tie and aligned along a vertical axis of the neck tie; and an opening located on an end of the neck tie wherein the opening is placed around one of the plurality of buttons to hold the neck tie to the neck piece.

8. A combination bolo tie and neck tie in accordance with claim 1 wherein the neck tie has a holder coupled to a back portion of the neck tie for holding a smaller end of the neck tie and the neck cord behind a wider section of the neck tie.

9. A combination bolo tie and neck tie comprising, in combination:

an interchangeable neck cord for supporting the combination bolo tie and neck tie around a neck of a wearer;

an interchangeable neck piece coupled to the interchangeable neck cord;

an interchangeable neck tie coupled to the interchangeable neck piece;

a holding bar coupled to the interchangeable neck piece for securing the interchangeable neck cord to the interchangeable neck piece;

a neck tie holder coupled to the interchangeable neck piece for coupling the interchangeable neck tie to the interchangeable neck piece; and an adjustment mechanism coupled to the interchangeable neck tie for holding the interchangeable neck tie to the interchangeable neck piece and for adjusting a length of the interchangeable neck tie.

10. A combination bolo tie and neck tie in accordance with claim 9 wherein the adjustment mechanism comprises:

at least one button coupled to a rear section of the interchangeable neck tie; and at least one opening located on an end of the interchangeable neck tie wherein the opening is placed around one of the at least one button to hold the interchangeable neck tie to the interchangeable neck piece.

11. A combination bolo tie and neck tie in accordance with claim 9 wherein the adjustment mechanism comprises:

a plurality of buttons coupled to a rear section of the interchangeable neck tie and aligned along a vertical axis of the interchangeable neck tie; and an opening located on an end of the interchangeable neck tie wherein the opening is placed around one of the plurality of buttons to hold the interchangeable neck tie to the interchangeable neck piece.

12. A combination bolo tie and neck tie in accordance with claim 9 wherein the interchangeable neck tie has a holder coupled to a back portion of the interchangeable neck tie for holding a smaller end of the interchangeable neck tie and the interchangeable neck cord behind a wider section of the interchangeable neck tie.

13. A method of providing a combination bolo tie and neck tie comprising the steps of:

providing an interchangeable neck cord for supporting the combination bolo tie and neck tie around a neck of a wearer;

providing an interchangeable neck piece coupled to the interchangeable neck cord;

providing an interchangeable neck tie coupled to the interchangeable neck piece; and providing an adjustment mechanism coupled to the interchangeable neck tie for holding the interchangeable neck tie to the interchangeable neck piece and for adjusting a length of the interchangeable neck tie.

14. The method of claim 13 further comprising the steps of:

providing a holding bar coupled to the interchangeable neck piece for securing the interchangeable neck cord to the interchangeable neck piece; and providing a neck tie holder coupled to the interchangeable neck piece for coupling the interchangeable neck tie to the interchangeable neck piece.

15. The method of claim 13 wherein the step of providing an adjustment mechanism further comprises the steps of:

providing at least one button coupled to a rear section of the interchangeable neck tie; and providing at least one opening located on an end of the interchangeable neck tie wherein the opening is placed around one of the at least one button to hold the interchangeable neck tie to the interchangeable neck piece.

16. The method of claim 13 wherein the step of providing an adjustment mechanism further comprises the steps of:

providing a plurality of buttons coupled to a rear section of the interchangeable neck tie and aligned along a vertical axis of the interchangeable neck tie; and providing an opening located on an end of the interchangeable neck tie wherein the opening is placed around one of the plurality of buttons to hold the interchangeable neck tie to the interchangeable neck piece.

17. The method of claim 13 further comprising the step of providing a holder device coupled to a back portion of the interchangeable neck tie for holding a smaller end of the interchangeable neck tie and the interchangeable neck cord behind a wider section of the interchangeable neck tie.

* * * * *